US005821489A

United States Patent [19]

Arai et al.

[11] Patent Number: 5,821,489

[45] Date of Patent: Oct. 13, 1998

[54] TRIM SWITCH FOR RADIO CONTROL TRANSMITTER

[54]

[75] Inventors: Masahiro Arai; Masashi Tokita, both of Mobara, Japan

[73] Assignee: Futaba Denshi Kogyo K.K., Mobara, Japan

[21] Appl. No.: 739,291

[22] Filed: Oct. 29, 1996

[30] Foreign Application Priority Data

Oct. 31, 1995 [JP] Japan ..... 7-283452

[51] Int. Cl.[6] ..... H01H 3/00

[52] U.S. Cl. ..... 200/339; 200/552; 200/5 B; 200/330

[58] Field of Search ..... 200/339, 552, 200/5 B, 330, 332, 334, 333

[56] References Cited

U.S. PATENT DOCUMENTS

| | | | |
|---|---|---|---|
| 5,329,278 | 7/1994 | Dombroski | 200/339 |
| 5,332,874 | 7/1994 | Orr et al. | 200/5 B |
| 5,510,587 | 4/1996 | Reiter | 200/330 |

*Primary Examiner*—David J. Walczak
*Attorney, Agent, or Firm*—Oblon, Spivak, McClelland, Maier & Neustadt, P.C.

[57] ABSTRACT

A trim switch for a radio control transmitter capable of exhibiting satisfactory operability and permitting concurrent operation of two such switch members to be readily selectively carried out in a transmitter which is adapted to operate two-in-a-set switch members. The trim switch includes two switch members and a switch lever including two actuation sections arranged in correspondence to the two switch members. The switch lever is constructed so as to operate the switches either individually or concurrently.

3 Claims, 4 Drawing Sheets

TRIM SWITCH FOR RADIO CONTROL TRANSMITTER

BACKGROUND OF THE INVENTION

This invention relates to a trim switch for a radio control transmitter, and more particularly to a trim switch arranged in a radio control transmitter so as to operate two switch members with enhanced operability.

A radio control transmitter which is currently used in the art is generally provided with a switch commonly called a trim switch. The trim switch is arranged so as to set relationship between the amount of control of a control section of the radio control transmitter and the amount of movement of a movable section of a unit to be controlled (hereinafter referred to as "controlled unit").

The conventional radio control transmitter will be more detailedly described hereinafter with reference to FIGS. 4(*a*) and 4(*b*) by way of example, wherein FIG. 4(*a*) is a plan view of the radio control transmitter and FIG. 4(*b*) is a side view thereof.

The radio control transmitter which is generally designated at reference numeral 11 in FIGS. 4(*a*) and 4(*b*) includes two stick levers 112 and 113, which are arranged on a surface of the transmitter so as to be operable in both vertical and lateral directions and automatically returnable to a neutral position depending on a purpose of operation. Thus, the transmitter 111 transmits a radio wave from an antenna 114 depending on the amount of operation of the stick levers 112 and 113, to thereby carry out remote control of the controlled unit.

Reference numeral 117 designates trim switches, each of which is constructed of a pair of button switch elements 115 and 116, which are arranged in correspondence to a direction of operation of the stick levers 112 and 113. Thus, the trim switch 117 carries out fine adjustment of the amount of operation (control) of the controlled unit with respect to a position of operation of the stick levers 112 and 113 by operation of the button switch elements 115 and 116.

The button switch elements 115 and 116 of the trim switch 117, as shown in FIG. 3, each are constructed so as to operate, with one or two fingers, each of a pair of switch members 101 mounted on a trim board 3 such as a circuit board or the like arranged in a housing 1 of the transmitter 111 and each of a pair of key tops 100 arranged so as to be outwardly projected from the housing 1.

For example, when the controlled unit is a model plane, the stick lever 112 is constructed so as to automatically return in both vertical and lateral directions, wherein vertical operation of the stick lever 112 permits an elevator of the model plane to be controlled and lateral operation thereof leads to control of an aileron thereof. Also, the stick lever 113 is adapted to automatically return in only lateral direction, wherein vertical movement of the stick lever 113 controls a throttle of an engine of the model plane or the like and lateral movement thereof controls a rudder thereof.

Control of the model plane may be finely adjusted by operating the button switch elements 115 and 116 of the trim switch 117 so that the model plane may horizontally aviate without operation of the stick levers 112 and 113. Thus, pushing of one switch member 101 permits the above-described relationship between the amount of control of the control section of the radio control transmitter and the amount of movement of the movable section of the controlled unit to be adjusted in a predetermined direction, whereas pushing of the other switch member 101 permits the relationship to be adjusted in an opposite direction. Also, concurrent pushing of both switch members 101 permits trim once set to be reset.

Unfortunately, the conventional trim switch including two such switch members each provided with the key top has a disadvantage of being hard to discriminate a direction in which operation is carried out. Also, it has another disadvantage of rendering concurrent pushing of the two switch members hard.

SUMMARY OF THE INVENTION

The present invention has been made in view of the foregoing disadvantage of the prior art.

Accordingly, it is an object of the present invention to provide a trim switch for a radio control transmitter which is adapted to operate two-in-a-set switch members and capable of exhibiting satisfactory operability and permitting concurrent operation of two such switch members to be readily carried out.

It is another object of the present invention to provide a trim switch which is capable of permitting concurrent operation of two such switch members to be readily carried out.

In accordance with the present invention, a trim switch for a radio control transmitter for remote control of a controlled unit by means of a radio wave is provided. The trim switch includes two switch members and a switch lever including two actuation sections arranged in correspondence to the two switch members. The switch lever is constructed so as to operate the switches either individually or concurrently.

In a preferred embodiment of the present invention, the switch lever is pivotably supported at a bearing section provided between the actuation sections.

In a preferred embodiment of the present invention, the trim switch also includes a bias means for upwardly forcing the switch lever. The switch lever is arranged so as to be vertically movable within a predetermined range at the bearing section.

In a preferred embodiment of the present invention, the bearing section is fixedly arranged at a predetermined position and the switch lever is so constructed that a portion thereof between the bearing section and each of the actuation sections of the switch lever exhibits flexibility.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 4(*b*) is a side view of the radio control transmitter shown in FIG. 4(*a*).

DETAILED DESCRIPTION OF THE PREFERRED EMBODIMENTS

Figure 1:
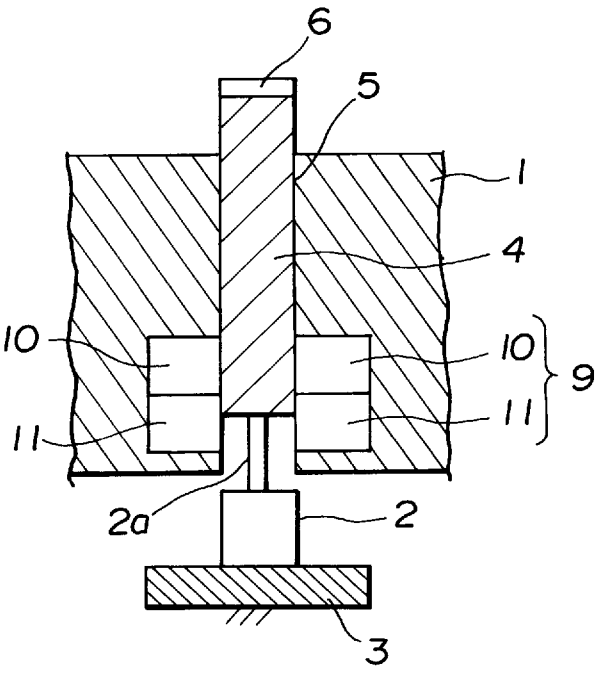
FIGS. 1(*a*) and 1(*b*) each are a fragmentary sectional view showing an embodiment of a trim switch for a radio control transmitter according to the present invention.
Figure 1:
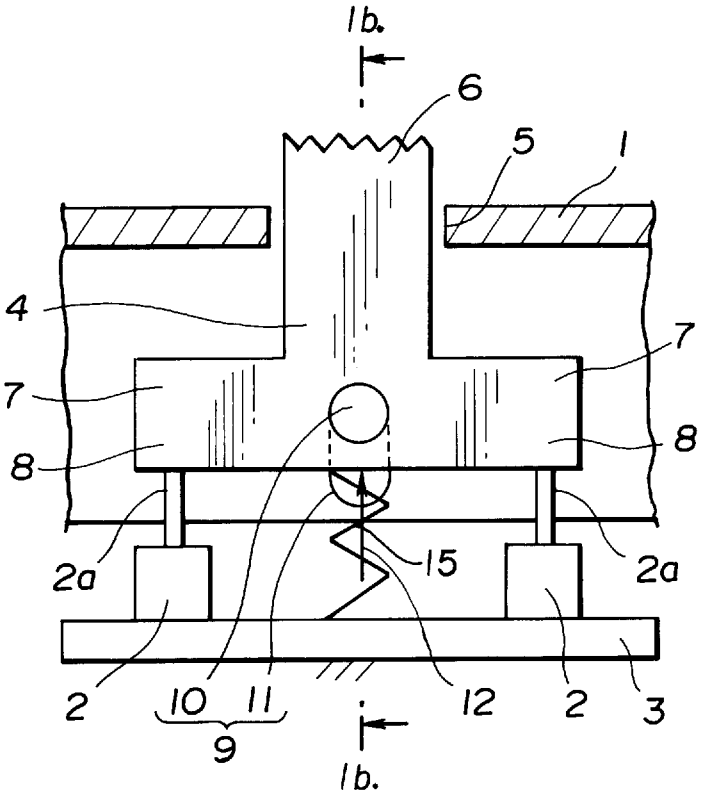

Now, a trim switch for a radio control transmitter according to the present invention will be described hereinafter with reference to FIGS. 1(*a*) to 2(*b*), wherein like reference numerals designate like or corresponding parts throughout.

Referring first to FIGS. 1(*a*) and 1(*b*), a first embodiment of a trim switch for a radio control transmitter according to the present invention is illustrated. A radio control transmitter to which a trim switch of the illustrated embodiment may be applied includes a housing 1, in which a trim board 3 having two switch members 2 mounted thereon is arranged. The two switch members 2 constitute one of essential parts of the trim switch of the illustrated embodiment. The switch members 2 each includes an actuator 2*a*.

The trim switch of the illustrated embodiment also includes a switch lever 4, which constitutes another essential part of the trim switch of the illustrated embodiment. The switch lever 4 is formed into a substantially inverted T shape and includes a central operation section 6 arranged so as to be outwardly projected through a switch hole 5 of the housing 1 and a pair of arms 7 arranged in the housing 1 so as to be positioned on both sides of the operation section 6. The arms 7 each are so constructed that a distal end thereof functions as an actuation section 8 for actuating the actuator 2*a* of each of the switch members 2.

The operation section 6 is provided at a proximal portion thereof with a bearing section 9, through which the switch lever 4 is pivotally supported on the housing 1 of the radio control transmitter. In the illustrated embodiment, the bearing section 9 is constructed of support shafts 10 mounted on both sides of the switch lever 4 in a manner to extend in a substantially horizontal direction perpendicular to a longitudinal direction of the arms 7 in a pair and a shaft hole 11 formed at the housing 1 so as to pivotably receive the support shafts 10 therein. The shaft hole 11 is formed into a vertically elongated shape, so that the support shafts 10 may be vertically moved in the shaft hole 11. This results in the switch lever 4 being vertically movable within a range of a length of the shaft hole 11 of the bearing section 9.

The switch lever 4 is provided on a lower surface thereof with a bias means (not shown) for upwardly forcing or urging the switch lever 4. In FIG. 1(*a*), an arrow 12 designates force which such a bias means 15 generates to upwardly force the switch lever 4. The bias means 15 may be constructed of an elastic member such as a leaf spring, a coiled spring or the like or formed of an elastic material such as a rubber material or the like. Alternatively, the switch lever may be constructed so as to exhibit elasticity, to thereby provide the bias means. This may be accomplished by reducing a thickness of the switch lever to a certain degree. The bias means thus constructed functions to upwardly urge the switch lever 4, so that the support shafts 10 may be pressedly abutted against an upper end of the shaft hole 11, resulting in being set at an upper limit position.

Now, the manner of operation of the trim switch of the illustrated embodiment thus constructed will be described hereinafter.

When it is desired that relationship between the amount of operation of the operation section of the transmitter and the amount of movement of a movable section of a controlled unit is adjusted in a predetermined direction, one of the two switch members 2 is pushed. For this purpose, the operation section 6 of the switch lever 4 is pushed in a direction toward one of the switch members 2, so that the switch lever 4 is pivotally moved in the same direction about the bearing section 9. In this instance, the support shafts 10 of the switch lever 4 are kept forced against the upper end of the shaft hole 11, so that the switch lever 4 may be pivotally moved about the support shafts 10, resulting in the actuation section 8 of one of the arms 7 forcing the actuator 2*a* of the one switch member 2. When the operation section 6 of the switch lever 4 is forced toward the other switch member 2, trim is adjusted in a direction opposite to the direction described above. Thus, a direction of operation in trim adjustment can be surely confirmed.

If it is desired to reset the trim, the two switch members 2 are concurrently pushed. For this purpose, the operation section 6 of the switch lever 4 is downwardly pushed against biasing force of the bias means acting in the direction indicated at the arrow 12. This causes the support shafts 10 of the switch lever 4 to be downwardly moved in the shaft hole 11, so that the whole switch lever 4 is forcibly downwardly moved into the housing 1. This results in the operation sections 8 of the arms 7 of the switch lever 7 thus downwardly moved concurrently pushing the actuators 2*a* of the switch members 2.

Figure 2B:
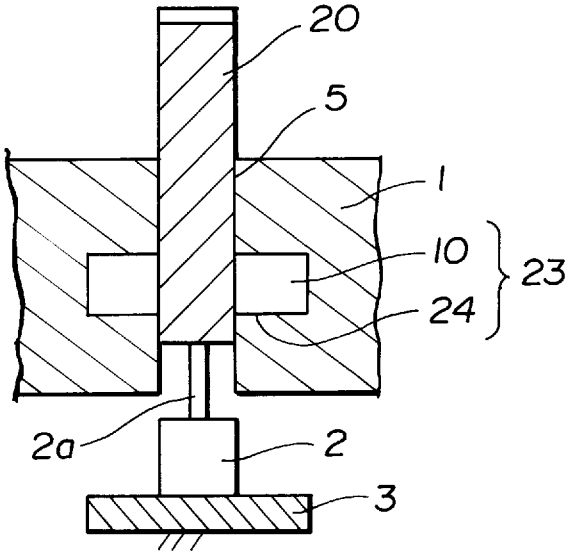
FIGS. 2(*a*) and 2(*b*) each are a fragmentary sectional view showing another embodiment of a trim switch for a radio control transmitter according to the present invention.
Figure 2A:
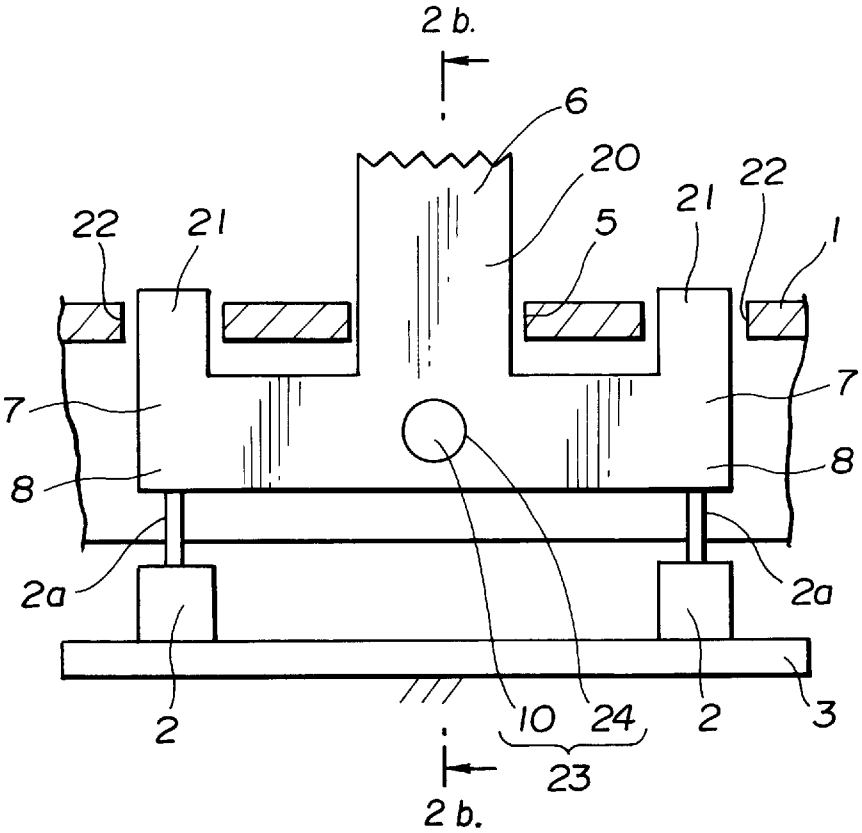
Figure 3:
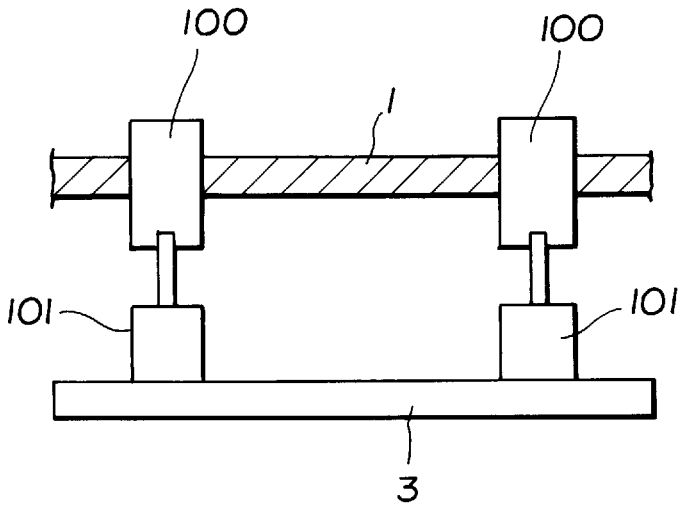
FIG. 3 is a fragmentary sectional view showing an example of a conventional trim switch for a radio control transmitter.
Figure 4:
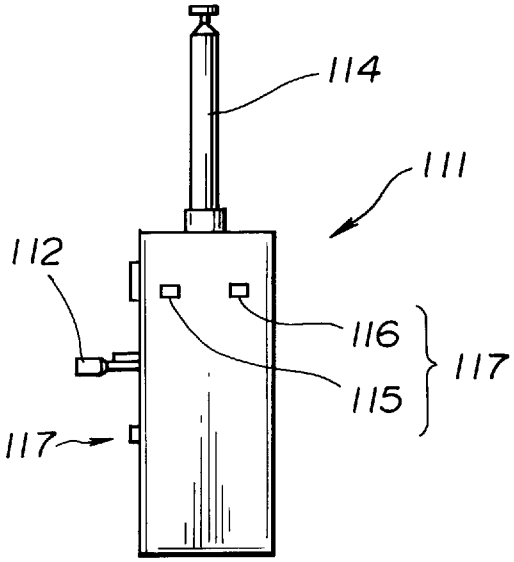
FIG. 4(*a*) is a plan view showing an example of a conventional radio control transmitter.
Figure 4:
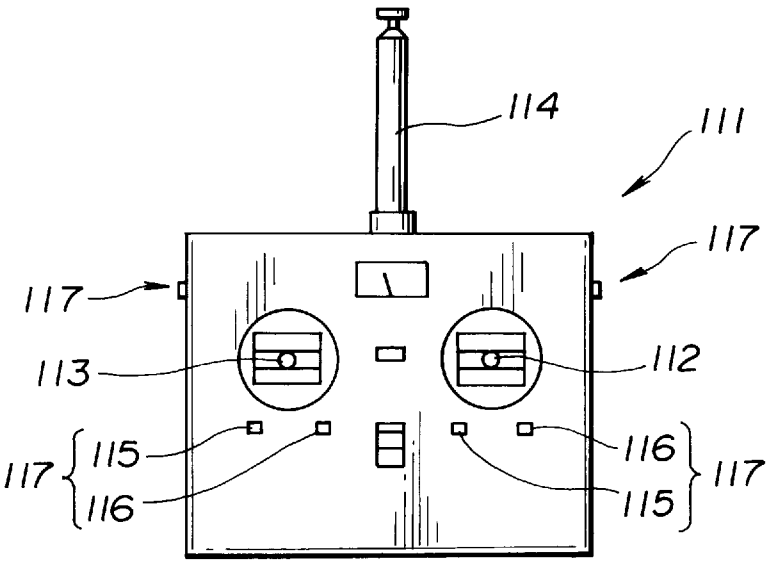

Referring now to FIGS. 2(*a*) and 2(*b*), a second embodiment of a trim switch for a radio control transmitter according to the present invention is illustrated. In a trim switch of the illustrated embodiment, a switch lever 20 is formed into a substantially inverted T shape and provided at a central portion thereof with an operation section 6, which is arranged so as to outwardly extend through a first switch hole 5 of a housing 1 of a transmitter. The operation section 6 is provided on both sides of a portion thereof positioned in the housing 1 with a pair of arms 7. The arms 7 each have a distal end acting as an actuation section 8 for actuating an actuator 2*a* of each of switch members 2. The actuation section 8 of each of the arms 7 is formed at an upper portion thereof into a projection-like operation section 21. The operation sections 21 are arranged so as to extend through second switch holes 22 of the housing 1.

The operation section 6 is provided at a proximal portion thereof with a bearing section 23, through which the switch lever 20 is pivotably supported on the housing 1. In the illustrated embodiment, the bearing section 23 is constructed of a pair of support shafts 10 projectedly mounted on both surfaces of the switch lever 20 so as to extend in a substantially horizontal direction perpendicular to a longitudinal direction of the arms 7 and a shaft hole 24 formed at the housing 1 for pivotally supporting the support shafts 10 therein. The shaft hole 24 is formed into a diameter corresponding to an outer diameter of the support shafts 10. More particularly, the bearing section 23 is fixedly arranged at a predetermined position, so that movement of the switch lever 20 other than pivotal movement thereof about the bearing section 23 is not permitted. Also, the arms 7 of the switch lever 20 are constructed so as to exhibit flexibility.

Now, the manner of operation of the trim switch of the second embodiment thus constructed will be described hereinafter.

When it is desired that relationship between the amount of operation of the operation section of the transmitter and the amount of movement of a movable section of a controlled unit is adjusted in a predetermined direction, one of the two switch members 2 is pushed. For this purpose, the operation section 6 of the switch lever 20 is pushed in a direction toward one of the switch members 2, so that the switch lever 20 is pivotally moved in the same direction about the bearing section 23. This causes the switch lever 20 to be pivotally moved about the support shafts 10, resulting in the actuation section 8 of one of the arms 7 forcing the actuator 2*a* of the one switch member 2. When the operation section 6 of the switch lever 20 is forced toward the other switch member 2 or the operation section 21 is pushed, trim is adjusted in a direction opposite to the direction described above. Thus, a direction of operation in trim adjustment can be surely confirmed.

When it is desired to reset the trim, the two switches 2 are concurrently pushed. For this purpose, the two operation sections 21 are concurrently pushed. Although this does not cause any movement of the bearing section 23 of the switch lever 20 because it is fixedly mounted, the arms 7 are caused to be downwardly deflected due to flexibility thereof; so that the actuation sections 8 of the arms 7 concurrently force the actuators 2*a* of the switch members 2.

In the trim switch of the second embodiment, the shaft hole 24 for the bearing section 23 may be formed into a vertically elongated shape as in the first embodiment described above. In this instance, a bias means may be arranged for upwardly moving the whole switch lever 20 as in the first embodiment. Alternatively, the actuators 2*a* of the two switch members 2 may be constructed so as to exhibit restoring force sufficient to raise the whole switch lever 20 to forcibly abut the support shafts 10 against an upper end of the elongated shaft hole, resulting in acting as the bias means by itself.

In each of the embodiments described above, the bearing section for pivotally supporting the switch lever is constructed of the support shafts provided on the switch lever and the shaft hole formed at the housing. However, the bearing section is not limited to such construction so long as it permits the switch lever to be pivotally supported thereon. For example, the embodiments each may be so constructed that a pair of support shafts are coaxially provided on the housing while being spaced from each other at a predetermined interval and opposite to each other and a shaft hole in which each of the support shafts is fitted is arranged on a side of the switch lever. In such a modification, vertical movement of the switch lever is ensured by forming the shaft hole of the switch lever into a vertically elongated shape.

The trim switch of each of the embodiments may be generally applied to a switch mechanism which is adapted to have a two-in-a-set switch members incorporated therein.

As can be seen from the foregoing, the trim switch of the present invention permits a direction of operation thereof to be readily confirmed or determined by finger touch when it is applied to a radio control transmitter.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A trim switch for a radio control transmitter, comprising:

two switch members;

a switch lever including two actuation sections and a bearing section provided between said two actuation sections, each of said two actuation sections being arranged so as to correspond to each of said two switch members respectively, said switch lever being pivotably supported at said bearing section; and said switch lever being constructed so as to operate said two switch members either individually or concurrently.

2. A trim switch as defined in claim 1, further comprising:

a bias unit which upwardly forces said switch lever, said switch lever being arranged so as to be vertically movable within a predetermined range at said bearing section.

3. A trim switch as defined in claim 1, wherein said switch lever is supported at said bearing section so as not to move vertically, and wherein said switch lever has a flexibility between said bearing section and each of said two actuation sections.

* * * * *